US006070577A

United States Patent [19]

Troup

[11] Patent Number: 6,070,577

[45] Date of Patent: Jun. 6, 2000

[54] RESERVE AIR FOR UNDERWATER DIVING

[76] Inventor: Jan M. Troup, 209 Split Road Rd., The Woodlands, Tex. 77381

[21] Appl. No.: 08/865,568

[22] Filed: May 29, 1997

[51] Int. Cl.[7] ..... A62B 7/04

[52] U.S. Cl. ..... 128/205.22; 128/204.18; 128/201.27; 128/204.26

[58] Field of Search ..... 128/205.22, 204.18, 128/205.24, 201.27, 201.28, 204.26, 205.11, 202.14

[56] References Cited

U.S. PATENT DOCUMENTS

| | | | |
|---|---|---|---|
| 1,695,930 | 12/1928 | Schroder | 128/204 ZG |
| 2,854,001 | 9/1958 | Humblet | 128/142 |
| 3,483,865 | 12/1969 | Jansson et al. | 128/142 |
| 3,536,071 | 10/1970 | Ferrando | 128/142.5 |
| 3,820,537 | 6/1974 | Almqvist et al. | 128/142.5 |
| 4,062,356 | 12/1977 | Merrifield | 128/142.2 |
| 4,068,657 | 1/1978 | Kobzan | 128/142 |
| 4,111,342 | 9/1978 | Kirby | 137/557 |
| 4,640,215 | 2/1987 | Purifoy, Jr. | 114/315 |
| 4,722,333 | 2/1988 | Bartos | 128/205.22 |
| 4,798,203 | 1/1989 | Bartos | 128/205.22 |
| 4,949,889 | 8/1990 | Carson | 224/270 |
| 4,951,660 | 8/1990 | Lubitzsch | 128/201.27 |
| 5,271,387 | 12/1993 | Murray | 128/200.24 |
| 5,348,001 | 9/1994 | Danon | 128/205.24 |
| 5,411,018 | 5/1995 | Rinehart | 128/201.28 |
| 5,529,096 | 6/1996 | Rowe, Jr. et al. | 141/21 |
| 5,584,289 | 12/1996 | Wise | 128/205.22 |

*Primary Examiner*—John G. Weiss
*Assistant Examiner*—V. Srivastava
*Attorney, Agent, or Firm*—Mark R. Wisner

[57] ABSTRACT

An improved alternative breathable gas source for underwater breathing to be used in combination with a main air tank and a pressure regulator connected to a main air tank. The improvement comprises combining an auxiliary air tank having a manifold and pressure regulator, where the manifold is in fluid communication with the main air tank and is provided with a check valve therein for precluding air flow from the manifold to the main air tank. Thus when the main air tank is filled with pressurized air, the auxiliary air tank is also filled with pressurized air, but should the main air tank become depressured, the check valve prevents air flow from the auxiliary air tank to the main tank. The improvement also comprises an alternate air supply system having an auxiliary air tank where the auxiliary air tank is in combination with a pressure regulator that regulates air to a pressure for comfortable breathing. Another improvement consists of the auxiliary air tank being capable of providing breathable air while also being capable of filling a buoyancy control device.

6 Claims, 2 Drawing Sheets

RESERVE AIR FOR UNDERWATER DIVING

FIELD OF THE INVENTION

The subject invention relates to an apparatus and method of providing breathable gas from a reserve air supply to be used in conjunction with a self contained underwater breathing apparatus (SCUBA). Specifically, the subject invention relates to a gas supply, in addition to the primary supply, which is used in an emergency situation. More specifically, the subject invention relates to a supply which constitutes a redundant air supply in the event of failure of the diver's primary equipment or in the event the primary supply of air is exhausted.

BACKGROUND OF THE INVENTION

Underwater diving is an activity enjoyed as a hobby and engauged in as a necessity to perform underwater services. However, both amateurs and professionals are susceptible to poor judgment regarding the amount of their primary air/oxygen reserves, thus risking consumption of their primary air supply before they are able to surface. Also, regardless of care, all divers are subject to equipment failure and total loss of air supply.

In an environment as unforgiving as the underwater environment, a backup air supply is required for safety. Reserve underwater breathing systems do currently exist. They are typically comprised of an air supply which is separate from the main, or primary, air tank and which is held in reserve to be used either by the diver or by a second diver whose primary air supply is unavailable or exhausted.

One type of separate air supply, often referred to as a pony bottle, consists of a pressurized air tank, typically smaller in volume than the main air tank, with attached primary and secondary regulator. Because they duplicate some of the component parts of the primary system, such systems are relatively costly. Further, such reserve air tanks must also be refilled separately from the main tank or external source, thus requiring an extra step in the refilling procedure. In short, although they can be valuable, there is room for improvement in both the use and the cost of reserve air supplies over such systems.

The patent literature discloses several attempts to improve on these goals. For instance, Rinehart. U.S. Pat. No. 5,411,018 discloses an underwater breathing system having an oxygen tank smaller than the main air supply connected in parallel to the main air supply by a selector switch designed to control the ratio of oxygen/air mixture a diver consumes. This system, however, is intended for use in decreasing the severity of decompression sickness (the "bends") rather than as a reserve supply of breathable gas. Further, if utilized as a reserve supply, the system is likely to be even more difficult and/or time consuming to deploy than the pony bottle described above. Also complicated and difficult to use is the device disclosed in Lubitzsch, U.S. Pat. No. 4,951,660. This patent discloses a diver's rescue apparatus comprised of a fillable buoyancy element and a breathing bag, wherein the apparatus regulates the air mixture metered into the breathing bag Almqvist et ai., U.S. Pat. No. 3,820,537 discloses an emergency self-contained underwater breathing apparatus (SCUBA) for supplementing a diver's normal gas supply including a helmet in combination with an auxiliary gas source capable of being supplied to the diver through a valve. In addition to the need for the helmet, the need for deployment disadvantages that apparatus.

None of the above cited references disclose a reserve air breathable gas supply system capable of receiving, air/oxygen flow from a main air tank, without allowing air/oxygen flow back into the main air tank. Nor do they disclose a "transparent" reserve air breathable gas supply system, i.e. a reserve system capable of supplying air/oxygen to a diver any time during a dive, without requiring deployment of that apparatus for use by the diver. Further, none of these prior patents discloses an apparatus with the additional convenience and safety features of structure which be used to fill a diver's buoyancy control device (BCD).

Therefore, it is a primary object of the present invention to provide a reserve air supply system capable of supplying air/oxygen to a diver without detaching the reserve air breathable gas supply system from the main air supply system.

It is a further object of the present invention to provide a reserve air supply system capable ot being replenished with air/oxygen concurrently with the replenishment of air or oxygen to the primary air supply system.

It is another object of the present invention to provide a reserve air breathable gas supply system that is transparent to the user, i.e. able to be filled without action on the part of the diver from the primary tank and then to provide air for breathing and to fill a diver's buoyancy control device (BCD), all without the need for operating valves, switching regulators, or other deployment.

SUMMARY OF THE INVENTION

The present invention is directed to an improved alternative air source for underwater breathing. More specifically the present invention is directed to an improved alternate breathable gas source for underwater breathing which is used in combination with a main air tank and a pressure regulator of a type available commercially which is connected to the main air tank. The alternate breathable gas source for underwater breathing is comprised of a manifold connected to an auxiliary tank, where the manifold provides fluid communication between the auxiliary air tank and the pressure regulator. A pressure port located on the manifold provides fluid communication between the main air tank and the manifold. Connected to the manifold is a check valve that allows flow from the main air tank to the manifold but prevents air flow from the manifold back into the main air tank. Also connected to the manifold is a high pressure gauge. A first stage regulator is connected to the manifold and is provided with a plurality of low pressure ports for connecting to the diver's so-called "safe second," or octopus.

Another aspect of the invention is directed to an alternative air supply system for underwater breathing where the auxiliary air tank preferably has a volume of 3 to 6 cubic feet (larger volumes are contemplated and may even be advisable depending Upon such factors as the depth and duration of the dive) and has an operating pressure generally less than about 4500 $lb/in^2$.

A further aspect of the invention is directed to an alternative air supply system for underwater breathing where the first stage regulator is provided with a plurality of low pressure ports connected to, for example, a second stage regulator, a buoyancy control device, or a second stage regulator in combination with a buoyancy control device. The second stage regulator regulates air to a pressure breathable by the diver.

An additional aspect, the alternate air supply system for underwater breathing of the present invention comprises a manifold which is provided with a plurality of pressure ports, preferably two, connected to, for example, a high pressure gauge for measuring pressure in the main air tank and to a transfer line which is connected to the main air tank for providing fluid communication between the manifold and the main air tank. In a preferred embodiment, the alternate air supply system for underwater breathing additionally comprises a connecting strap connecting the auxiliary air tank to the main air tank.

DETAILED DESCRIPTION OF THE PREFERRED EMBODIMENT

Figure 1:
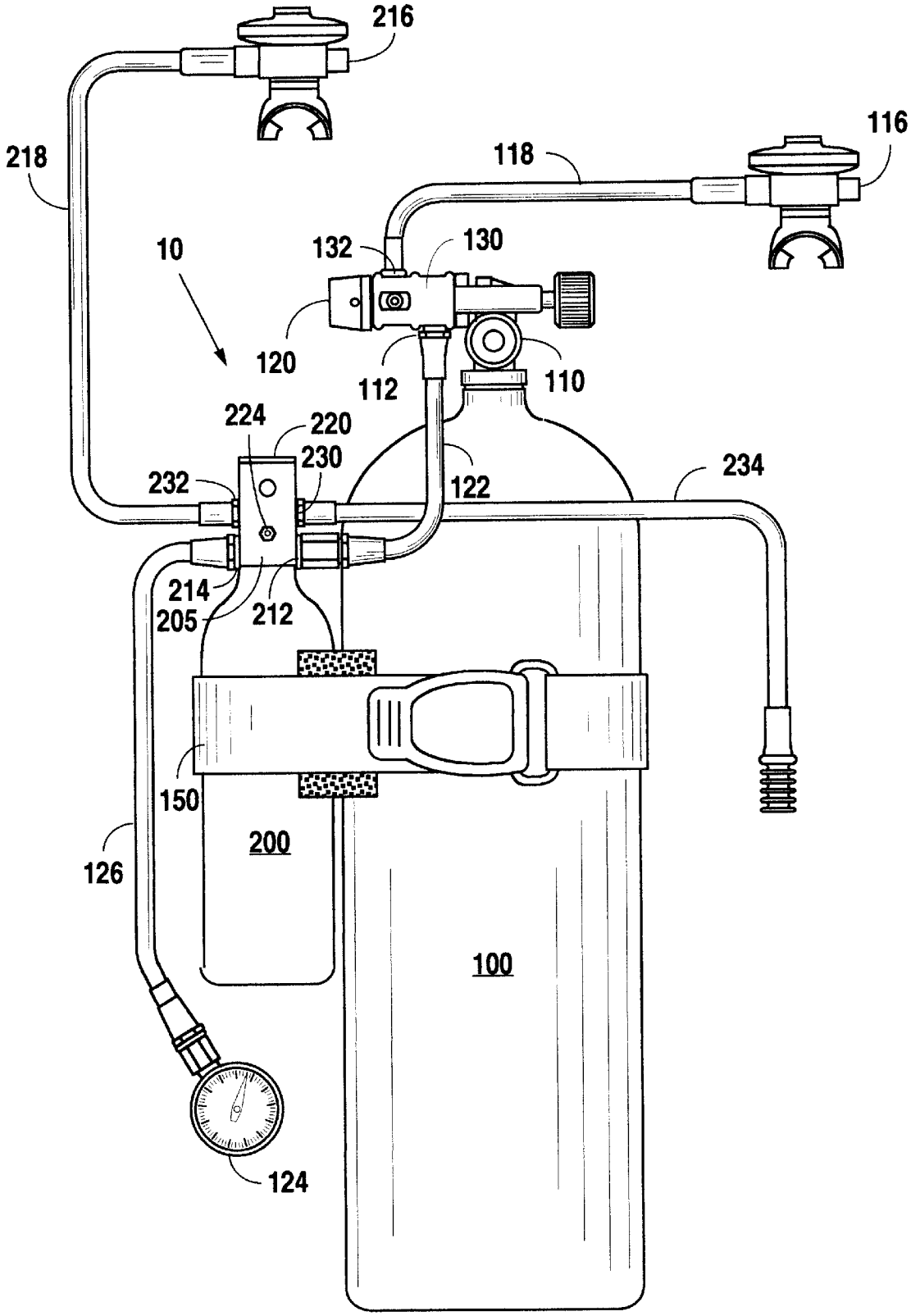
FIG. 1 is a side elevational view of a preferred embodiment of the alternative air source for underwater breathing of the present invention.

At reference numeral 10, FIG. 1 illustrates a preferred embodiment of an alternate air source for underwater breathing constructed in accordance with the present invention. The alternate air source 10 is connectable to a main air tank 100 having a main tank first stage regulator 120 mounted thereto, both the tank 100 and regulator 120 being of conventional construction and known in the art. Those skilled in the art who have the benefit of this disclosure will recognize that when reference is made herein to "air" and/or "breathable gas," it is intended to refer to any breathable gas or gas mixture such as oxygen, nitrogen, atmospheric air, or any mix thereof.

The main tank first stage regulator 120 is in fluid communication with the main air tank 100 through an on/off valve 110. A high pressure port 112 is located on the main tank first stage regulator 120. Also located on the main tank first stage regulator 120 is a main tank low pressure port 132. Connected to the main tank low pressure port 132 is a line 118, which connects the main air tank low pressure port 132 and the diver's main second stage regulator 116, and a high pressure gas transfer hose 122.

Figure 2:
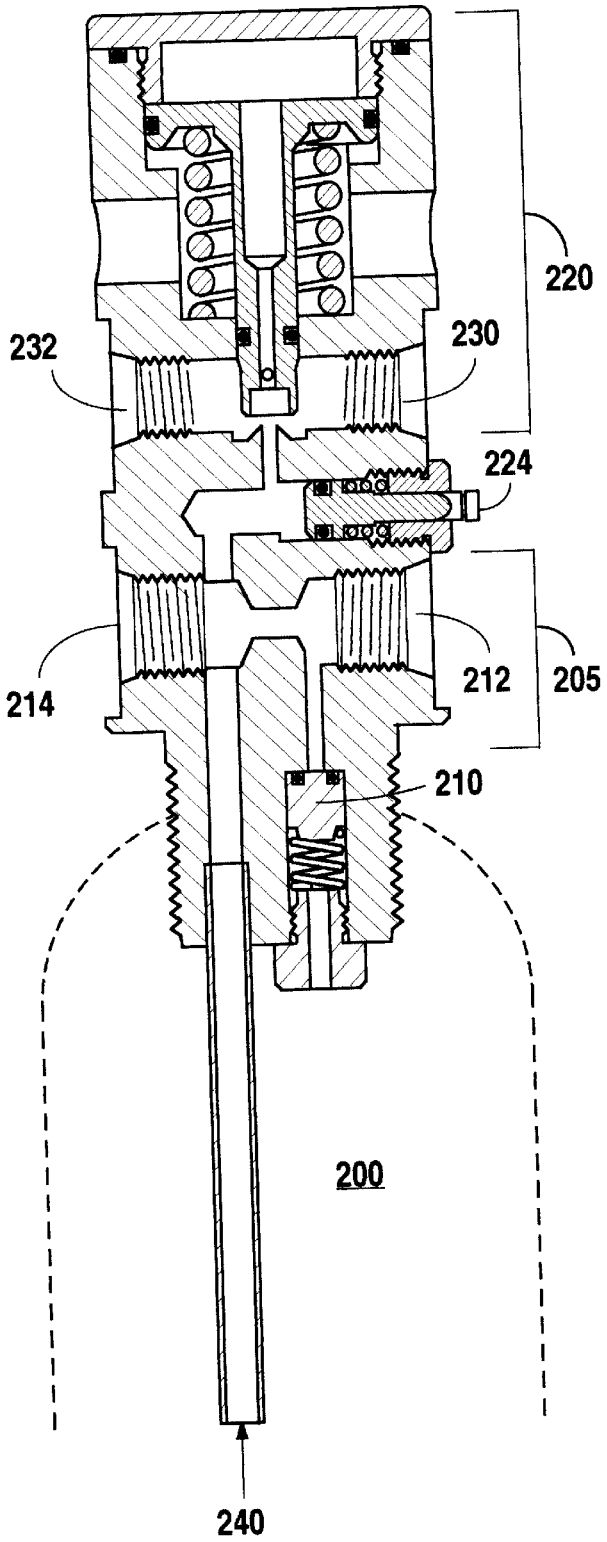
FIG. 2 is a sectional view of the manifold of the alternative air source of FIG. 1.

The alternate air source 10 depicted in FIG. 1 comprises an auxiliary air tank 200 having a manifold 205 connected thereto. The auxiliary air tank 200 is preferably kept proximate the main air tank 100, and in one preferred embodiment, auxiliary tank 200 is kept proximate the primary tank 100 with a connecting strap 150 which may be comprised of rubber, nylon, hemp, or a cotton material all as known in the art, the preferred material is a silicon based material. Alternatively, the auxiliary tank 200 is fitted into a sleeve comprised of a material which stretches tightly around the tank and which is provided with a VFLCRO® strap which overlaps with the belt on the diver's backpack (not shown) which holds the main air tank 100. Alternatively, the strap overlaps the belt of the diver's combination backpack/buoyancy compensation device, all as known in the art. An auxiliary air tank first stage regulator 220 is in fluid communication with the auxiliary air tank 200 through the passage 240 (see FIG. 2) in manifold 205.

The manifold 205 is also provided with two auxiliary air tank high pressure ports 212, 214. Attached to the auxiliary air tank high pressure port 212 is the high pressure gas transfer hose 122. Connected to auxiliary air tank high pressure port 214 is a high pressure gauge line 126 providing fluid communication between the manifold 205 and the main tank high pressure gauge 124. A check valve 210 (see FIG. 2) is disposed between the auxiliary air high pressure ports 212, 214 and the manifold 205. The check valve 210 is a one way valve allowing passage of high pressure air from the main tank 100 (through high pressure port 112 and hose 122), but precluding the passage of air from the manifold 205 through the valve 210. Manifold 205 is also provided with a connection for an auxiliary air tank high pressure gauge 224 (see FIG. 2) of a type known in the art.

Disposed on the auxiliary air tank first state regulator 220 are two auxiliary tank low pressure ports 230, 232. Connected to the auxiliary tank low pressure port 230 is an auxiliary tank low pressure line 234 which connects to a buoyancy control device, or BCD (not shown), of a conventional type. Another low pressure line 218 connects port 232 and an auxiliary second stage regulator 216, which is the diver's so-called safe second, or octopus. Those skilled in the art who have the benefit of this disclosure will recognize that the line 218 can also be used to connect a combination octopus regulator and BCD inflator of a type which is available commercially.

After the main tank 100 is filled with air, the diver's first stage regulator 120 is clamped onto the tank and the main on/off valve opened. At that time, high pressure air is supplied through port 112 to the auxiliary tank 200. At any time at which the pressure in tank 100 exceeds the pressure in auxiliary tank 200, air flows from the main air tank 100 through the port 112 into the high pressure gas transfer hose 122, through the check valve 210 in manifold 205, and into auxiliary tank 200. After the air passes through the check valve 210 it cannot flow back into the main air tank 100 since the check valve only allows air flow into the auxiliary air tank 200.

Main air tank 100 is filled with high pressure air until the desired pressure is reached inside the main air tank 100, which may be up to about 4500 lb/in$^2$ but which is more typically in the 2500–3500 psi range. Once the main air tank 100 is filled to the desired pressure, the auxiliary air tank 200 is pressurized to approximately the same pressure as the main air tank 100. During normal use of the main air tank 100 air flows from the main air tank 100 through the main air tank first stage regulator 120, which reduces the air pressure to about 125 to 145 lb/in$^2$ , and then through the main tank low pressure port 132 to the diver's main second stage regulator 116 via the main tank low pressure transfer line 118, all as known in the art and in conventional fashion. The diverts main second stage regulator 116 reduces the air pressure to that needed for comfortable breathing—about 1–5 atmosphere. During the dive, the air in the main tank 100, and therefore the pressure, is of course depleted, but should the main air tank 100 somehow depressurize due to a leak or rupture, the auxiliary air tank 200 maintains its pressure. The auxiliary air tank 200 cannot equalize to the lowered pressure in the main air tank 100 due to the check valve 210.

Note also that if the auxiliary tank 200 is used as the source of air for inflating the BCD (e.g., when the apparatus of the present invention is used with a combination octopus and BCD) such that the pressure in the tank 200 may drop lower below the pressure in the main tank 100, reserve tank 200 fills until the pressures in the tanks 100 and 200 are equalized. In this manner, there is always air available to inflate the BCD. Having air available for that purpose may play a role in safety which is as important as having a supply of air available in auxiliary tank 200 for breathing.

Should a diverts main air tank 100 no longer be able to supply air to the second stage regulator 116, or should the air in the main air tank 100 be depleted, the diver can then utilize the auxiliary air supply contained in the auxiliary air tank 200. The diver in distress accesses the auxiliary air supply simply by picking up and breathing through the auxiliary second stage regulator 216 in the same manner as the main second stage regulator 116. Auxiliary second stage regulator 216 receives air at approximately 125 lb/in$^2$ to 145 lb/in$^2$ from the auxiliary air low pressure transfer line 218 and regulates the air to a pressure of from about 1–5 atmospheres that is comfortable for breathing. Air in the low pressure transfer line 21 8 is received from the low pressure port 232. after passing through the auxiliary air first stage regulator 220 where it is regulated from about 3000 lb/in$^2$ to about 125 lb/in$^2$ to 145 lb/in$^2$. Air regulated in the auxiliary air first stage regulator 220 is supplied from the auxiliary air tank 200 and flows from the auxiliary air tank 200 through the passage 240 in manifold 205.

In addition to supplying air to the auxiliary second stage regulator 216, the 5 auxiliary air tank 200 can also be used to fill a buoyancy control device (not shown). To fill a buoyancy control device, air from the auxiliary air tank 200 is regulated through the auxiliary first stage regulator 220, flows out of the auxiliary first stage regulator 220 through the auxiliary air low pressure port 230, and into the buoyancy control device via the auxiliary low pressure transfer line 234. The capability to provide air to a buoyancy to control device, while providing air for breathing adds an additional level of safety and self rescue capability if an out of gas situation arises. In all prior known systems, if a diver runs out of breathable gas, no gas is available for inflating the buoyancy control device. However, with the auxiliary air supply system of the present invention, the air in the auxiliary tank 200 can be used for both breathing and inflating the buoyancy control device.

Having described a preferred embodiment of the present invention, those skilled in the art will recognize from this description that certain changes can be made in the component parts thereof without changing the manner in which those component parts function to achieve their intended result. Some such changes, such as the use of a combination octopus regulator and BCD, have been described above. For instance, it will be recognized by those skilled in the art that the present invention can be used in combination with a rebreather system in a similar way to that described herein. Other such changes could involve, for instance, the substitution of a clip or hanger for the strap 150 so that the auxiliary tank 200 is hung or fastened to the diver's equipment on the diver's front rather than strapped to the diver's back. Hanging or clipping the tank 200 to the diver's front has the advantage of allowing the diver to see the high pressure gauge 224 connected to manifold 205 and, in the case of a jacket-type BCD, offers the opportunity to provide a pocket or sleeve on the BCD for integrating the tank 200 with the BCD. All such changes are intended to fall within the spirit and scope of the following claims.

What is claimed is:

1. An apparatus for providing a source of breathable gas connectible to a main air tank, said apparatus comprising:

an auxiliary tank;

a manifold having a passage therethrough connected to said auxiliary tank;

a first port in said manifold connectible to a main air tank through the passage in said manifold;

a one way check valve between said auxiliary tank and the main tank for allowing the flow of a breathable gas from the main tank into said auxiliary tank and precluding gas flows from said auxiliary tank to the main air tank: and a first stage regulator in fluid communication with said auxiliary tank through a second port in said manifold.

2. The gas source as described in claim 1 wherein said manifold is provided with a third port for connecting to a pressure gauge.

3. The gas source as described in claim 2 wherein said manifold is provided with a pressure gauge in fluid communication with the air in said auxiliary tank.

4. A method of providing a reserve air supply to an underwater diver utilizing a main air tank having a regulator connected thereto comprising the steps of:

connecting a main air tank to an auxiliary air tank, the auxiliary air tank having, a first stage regulator connected thereto, the air pressure in the main tank being sufficient pressure to cause air to fill the auxiliary air tank from the main tank;

preventing the passage of air back out of tile auxiliary air tank to the main tank; and when the air in the main tank is either exhausted or unavailable to the diver, outputting air from the auxiliary air tank to the regulator connected thereto.

5. The method of claim 4 additionally comprising measuring the pressure of the air in the auxiliary tank.

6. The method of claim 4 additionally comprising measuring the pressure of the air between the main tank and the auxiliary tank.

* * * * *